United States Patent [19]

Miyamaru

[11] Patent Number: 4,874,254

[45] Date of Patent: Oct. 17, 1989

[54] COOLANT OUTLET ELEMENT FOR USE IN COOLING SYSTEM OF INTERNAL COMBUSTION ENGINE

[75] Inventor: Tsuneo Miyamaru, Toyota, Japan

[73] Assignee: Toyota Jidosha Kabushiki Kaisha, Aichi, Japan

[21] Appl. No.: 244,683

[22] Filed: Sep. 15, 1988

[30] Foreign Application Priority Data

Sep. 30, 1987 [JP] Japan ..... 62-149940[U]

[51] Int. Cl.[4] ..... G01K 1/00

[52] U.S. Cl. ..... 374/208; 123/41.15; 374/145

[58] Field of Search ..... 73/118.1, 49.7, 119 R; 374/144, 145, 208; 123/41.02, 41.05, 41.12, 41.15

[56] References Cited

U.S. PATENT DOCUMENTS 2,250,320 7/1941 Young ..... 374/145

4,381,744 5/1983 Terry ..... 123/41.15 X

*Primary Examiner*—Jerry W. Myracle

*Attorney, Agent, or Firm*—Kenyon & Kenyon

[57] ABSTRACT

A coolant outlet element to be mounted to a coolant extraction port in the cooling system of an internal combustion engine for mounting a plurality of temperature sensing elements for detecting coolant temperature, having a shell body formed with a coolant inlet port, a coolant outlet port, a coolant passage extending from the coolant inlet port to the coolant outlet port, at least one deflector wall portion for deflecting the coolant passage in a U-shape in the shell body, and a plurality of temperature sensing element fitting apertures positioned in series along the coolant passage as spaced apart from one another so as to receive the temperature sensing elements in a manner that temperature sensing portions of the temperature sensing elements are exposed to a flow of coolant passing along the coolant passage.

4 Claims, 2 Drawing Sheets

COOLANT OUTLET ELEMENT FOR USE IN COOLING SYSTEM OF INTERNAL COMBUSTION ENGINE

BACKGROUND OF THE INVENTION

1. Field of the Invention

The present invention relates to a coolant outlet element to be incorporated in the cooling system for an internal combustion engine, and more particularly to a coolant outlet element to which a plurality of temperature sensitive elements such as temperature sensors or temperature switches are to be attached.

2. Description of the Prior Art

In an internal combustion engine of a vehicle such as an automobile a plurality of temperature sensitive elements such as temperature switches and temperature sensors are provided at an intermediate portion of a coolant passage to detect the coolant temperature to obtain temperature parameters for various control operations such as fuel supply control, coolant fan control and exhaust gas purification control according to the temperature of the internal combustion engine and to indicate coolant temperature to the driver's seat. It has already been proposed to fit a plurality of such temperature sensitive elements as concentrated at a coolant outlet element, as described for example in Japanese Patent Publication Sho No. 61-38326 (1986).

The coolant outlet element has a coolant inlet port directly connected with a coolant extraction port provided in the internal combustion engine, a coolant outlet port directly or indirectly connected via a pipe line with a coolant pump, and a coolant passage extending between said coolant inlet port and said coolant outlet port, with a plurality of temperature sensitive elements being provided at an intermediate portion of said coolant passage.

However, if the coolant passage of the coolant outlet element is provided in a straight line form between the coolant inlet port and the coolant outlet port, then as the number of temperature sensitive elements to be attached increases, the coolant inlet port and coolant outlet port must be positioned largely apart from one another, and therefore the coolant outlet element has a long narrow shape. Therefore, depending on the type of the internal combustion engine, mounting conditions of the coolant outlet element in the vehicle, and/or the layout of the coolant pipe lines, such as long narrow coolant outlet element may be longer be appropriate. Further, when a coolant outlet element in which the coolant passage is provided has a straight line form, if the attachment apertures for the temperature sensitive elements are provided on the upper wall, side walls and bottom wall of the coolant outlet element in in order to make it as short as possible so that the orientation of the temperature sensitive elements varies according to the positions where they are fitted, the sensitivity to the coolant temperature of the different temperature sensitive devices becomes uneven, and the coolant temperature detection may become undesirably incorrect.

SUMMARY OF THE INVENTION

The object of the present invention is, in consideration of such problems in the conventional coolant outlet element of the above-mentioned type, to provide an improved coolant outlet element which is not long and narrow but has excellent compactness, and moreover allows attachment of temperature sensitive elements such that coolant temperature detection may be done under the same condition by each of a plurality of temperature sensitive elements.

The above-mentioned object is achieved according to the present invention by a coolant outlet element for use in an internal combustion engine for mounting a plurality of temperature sensing elements for detecting the temperature of coolant in the engine, comprising a shell body formed with a coolant inlet port adapted to be directly connected with a coolant extraction port of the engine, a coolant outlet port adapted to be connected with a coolant pump equipped in the engine, a coolant passage defined in said shell body to extend between said coolant inlet port and said coolant outlet port, at least one inner deflector wall portion for deflecting said coolant passage to turn in a U-shape in said shell body, and a plurality of temperature sensing element fitting apertures positioned in series along said coolant passage as spaced apart from one another so as to receive the temperature sensing elements in a manner that temperature sensing portions of said temperature sensing elements are exposed to a flow of coolant passing along said coolant passage.

The above-mentioned deflector wall portion may extend along a side of said coolant inlet port to end in a cylindrical partition wall portion, and said shell body may be formed with a through hole which extends through said cylindrical partition wall portion for receiving a fastening bolt. Such a structure of the deflector wall portion can provide a longer and less sharply curved coolant passage, and can also provide a good convenience for fastening the coolant outlet element to the coolant extraction port through said cylindrical partition wall portion.

A wall portion of said shell body defining a part of said coolant passage may be formed to have a curved portion substantially symmetrical to a corresponding part of said cylindrical partition wall portion with respect to said coolant inlet port, and said shell body may be formed with another through hole positioned outside of said curved wall portion to be substantially symmetrical to said through hole in said cylindrical partition wall portion with respect to said coolant inlet port. Such a structure of the shell body with regard to said curved wall portion and said through holes can provide highly firm and fluid tight mounting of the coolant outlet element to the coolant extraction port.

The outside configuration of said shell body may be locally convex at portions where the temperature sensing elements are fitted and locally concave at portions between two adjacent portions where the temperature sensing elements are fitted so as to maintain a substantially constant cross sectional area of said coolant passage therealong. It is highly desirable in order to obtain correct temperature detection of the coolant by a plurality of temperature sensing elements to maintain the cross sectional area of the coolant passage to be substantially constant therealong.

According to the above described construction, even when it is not possible to have the coolant inlet port and the coolant outlet port of the coolant outlet element disposed far apart, a relatively long coolant passage necessary for mounting a plurality of temperature sensing elements can still be ensured.

DESCRIPTION OF THE PREFERRED EMBODIMENT

The present invention will now be described in detail in terms of an embodiment and with reference to the accompanying drawings.

Figure 1:
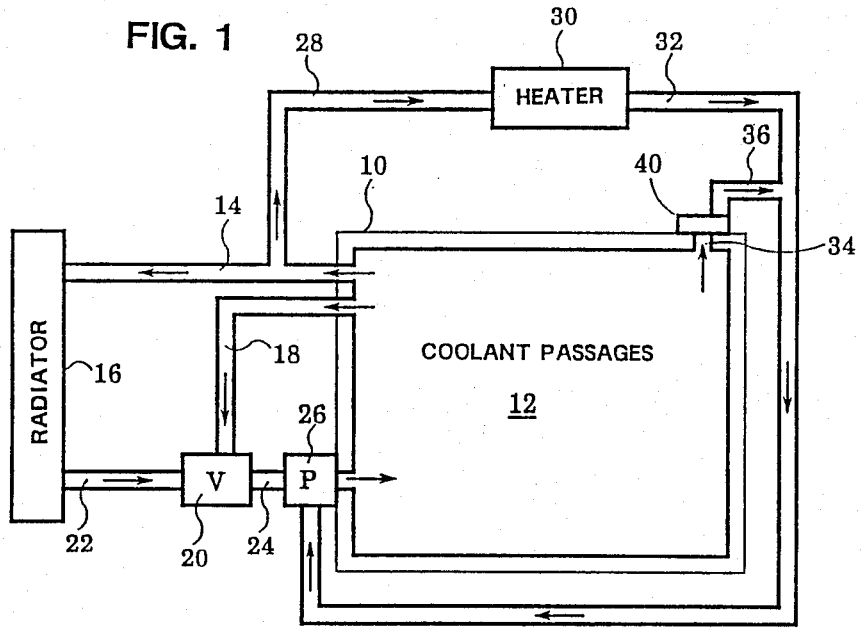
FIG. 1 is a schematic diagram showing the overall cooling system of an internal combustion engine to which is fitted the coolant outlet element according to the present invention.

Referring to FIG. 1, 10 indicates an internal combustion engine having a coolant passage 12 provided therein. The coolant passage 12 is connected by a coolant conduit 14 with a coolant inlet port of a radiator 16, and is also connected by a bypass conduit 18 with a temperature sensitive valve 20. The temperature sensitive valve 20 is, in addition to the bypass conduit 18, connected by a coolant conduit 22 with a coolant outlet port of the radiator 16 and by a coolant conduit 24 with an inlet port of a coolant pump 26. The coolant pump 26 is driven by an output shaft (not shown) of the engine 10 and pumps coolant toward the coolant passage 12. The coolant conduit 14 has a branch point at a middle portion thereof from which it is connected by a coolant conduit 28 with a coolant inlet port of a heater 30 for passenger compartment heating. The heater 30 has a coolant outlet port connected by a coolant conduit 32 with the inlet port of the coolant pump 26.

A coolant outlet element 40 is provided to have a shell body S formed with a coolant inlet port 42 (FIG. 3) and a coolant outlet port 44 (FIGS. 2 and 3) and attached to the internal combustion engine 10 by bolts or the like (not shown in the figure) in such a manner that the coolant inlet port 42 is directly connected with a coolant extraction port 34 provided in the internal combustion engine 10. The coolant outlet port 44 is connected with a middle portion of the coolant conduit 32 by a coolant conduit 36.

Figure 4:
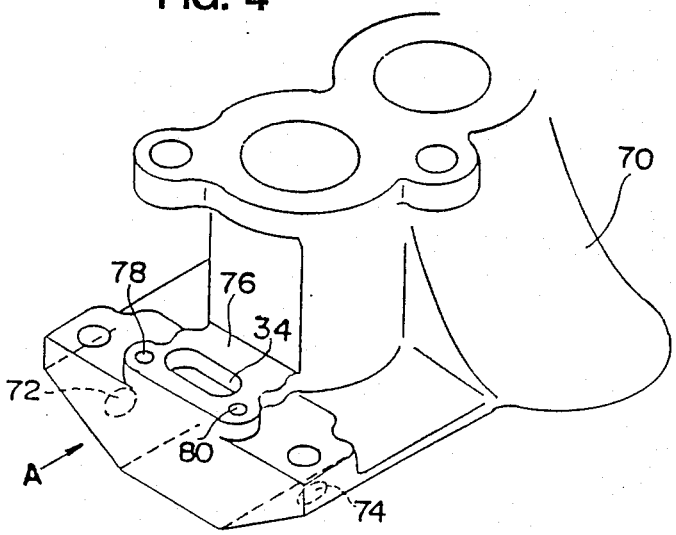
FIG. 4 is a perspective view showing an example of the inlet manifold of the engine to which is attached the coolant outlet element according to the present invention.

In a so-called V-type internal combustion engine, the coolant extraction port 34 is provided as shown in FIG. 4 near one end of an inlet manifold 70 fitted between the cylinder banks, as arranged to communicate with coolant passages in each of the cylinder banks of the V-type engine (not shown in the figure) through connection ports 72 and 74 formed in the inlet manifold 70. Around the coolant extraction port 34 there is provided an outlet element fitting surface 76 in which threaded holes 78 and 80 open. The coolant outlet element 40 is fitted over the outlet element fitting surface 76.

Figure 2:
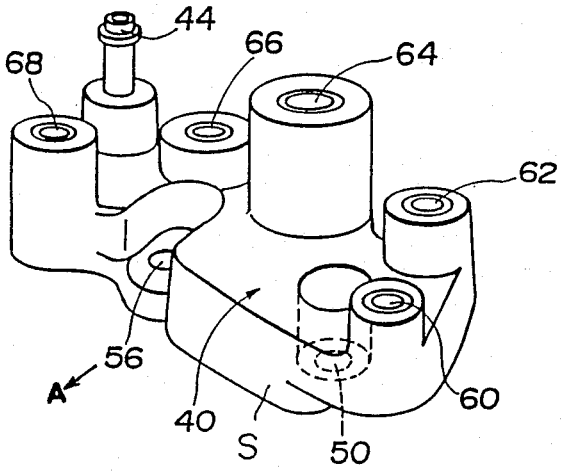
FIG. 2 is a perspective view showing one embodiment of the coolant outlet element according to the present invention.
Figure 3:
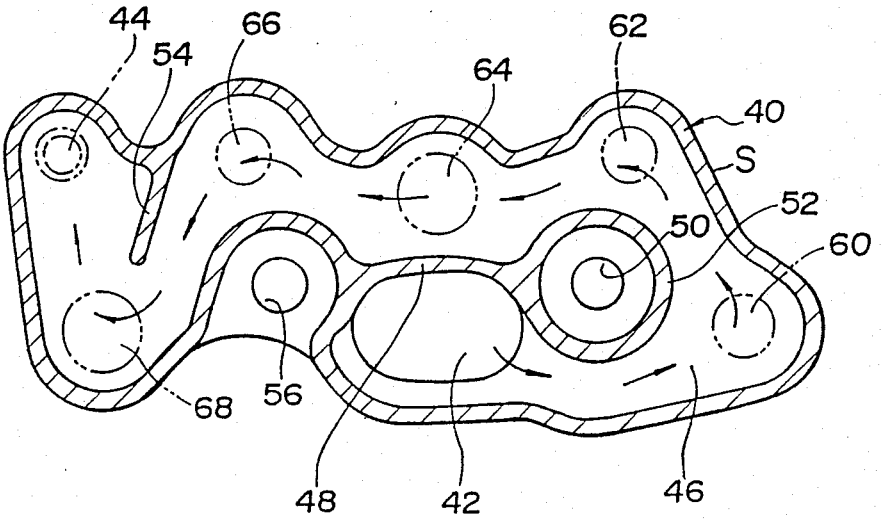
FIG. 3 is a sectional view showing one embodiment of the coolant outlet element according to the present invention.

As shown in FIGS. 2 and 3, the coolant outlet element 40 is provided with a coolant passage 46 defined in the shell body S thereof to extend from and around the coolant inlet port 42 in a serpentine fashion to the coolant outlet port 44. In more detail, an internal partition wall 48 is provided within the shell body S to extend along one side of the periphery of the coolant inlet port 42 and to join a cylindrical partition wall 52 provided adjacent to the coolant inlet port 42 so as to encircle a through hole 50 for receiving a fitting bolt, and forms together with the cylindrical partition wall 52 a coolant deflector wall in the coolant passage 46. Thus, the coolant passage 46 extends around this coolant deflector wall made of the internal partition wall 48 and the cylindrical partition wall 52. Further, inside the shell body S another coolant deflector wall 54 is provided adjacent the coolant outlet port 44 in order to make the coolant passage 46 more serpentine. In the upper wall portion of the shell body S there are provided a plurality, in this embodiment five, attachment apertures for temperature sensitive elements, 60, 62, 64, 66 and 68, spaced mutually apart in the direction of flow of coolant in the coolant passage 46.

In the intervals between each two adjacent apertures 60, 62, 64, 66 and 68, the coolant passage 46 has a narrower passage crosssectional area than in the locations of these apertures, so that th outside configuration of the shell body S is locally convex at portions where the apertures 60, 62, 64, 66 and 68 are provided and locally concave at portions between two adjacent portions where those apertures are provided to present a general shape of amoeba. This convex and concave configuration is so designed that, when the apertures 60, 62, 64, 66 and 68 have temperature sensing elements fitted thereto with their temperature sensitive portions being positioned within the coolant passage 46, the effective passage cross-sectional area of the coolant passage 46 is made more uniform along the route of coolant flow therein, so that there are no large differences in the flow rate of the coolant through the coolant passage 46. Therefore there will be no stagnant portions in the flow passage, and the coolant comes effectively in contact with the temperature sensing portions of the temperature sensing elements, so that the coolant temperature can be more correctly detected.

The temperature sensing portions of the temperature sensing elements fitted in the apertures 60, 62, 64, 66 and 68, though not shown in the figure, extend vertically downward from the upper wall portion of the shell body S as viewed in FIG. 2 to a central portion in the cross section of the coolant passage, and therefore the coolant in the coolant passage 46 flows uniformly traversing the temperature sensing portions so that asymmetries in the way in which the coolant flows over the temperature sensing portions are avoided.

A fitting bolt through hole 56 is formed in the cylindrical partition wall 52, and the two fitting bolt through holes 50 and 56 are located on opposite sides of the coolant inlet port 42. Therefore, the clamping force of the fitting bolts acts effectively on the periphery of the coolant inlet port 42, thereby improving the seal of the connection between the coolant inlet port 42 and the coolant extraction port 34.

The fixing bolt through holes 50 and 56 are aligned with the threaded holes 78 and 80 in the inlet manifold 70 shown in FIG. 4, and are screwed into these threaded holes 78 and 80. The coolant outlet element 40 is fitted to the inlet manifold 70 in such a way that arrow A in FIG. 2 coincides with arrow A in FIG. 4. The coolant outlet element 40 should desirably be so designed that it does not bulge outwardly from the inlet manifold 70.

Although the present invention has been described in detail with reference to a particular embodiment thereof, the invention is not limited to this embodiment and it will be clear to those skilled in the relevant art that various modifications are possible with respect to this embodiment within the scope of the invention.

I claim:

1. A coolant outlet element for use in an internal combustion engine for mounting a plurality of temperature sensing elements for detecting the temperature of coolant in the engine, comprising a shell body formed with a coolant inlet port adapted to be directly connected with a coolant extraction port of the engine, a coolant outlet port adapted to be connected with a coolant pump equipped in the engine, a coolant passage defined in said shell body to extend between said coolant inlet port and said coolant outlet port, at least one inner deflector wall portion for deflecting said coolant passage in turn in a U-shape in said shell body, and a plurality of temperature sensing element fitting apertures positioned in series along said coolant passage as spaced apart from one another so as to receive the temperature sensing elements in a manner that temperature sensing portions of said temperature sensing elements are exposed to a flow of coolant passing along said coolant passage.

2. A coolant outlet element according to claim 1, wherein said deflector wall portion extends along a side of said coolant inlet port to end in a cylindrical partition wall portion, and said shell body is formed with a through hole which extends through said cylindrical partition wall portion for receiving a fastening bolt.

3. A coolant outlet element according to claim 2, wherein a wall portion of said shell body defining a part of said coolant passage is formed to have a curved portion substantially symmetrical to a corresponding part of said cylindrical partition wall portion with respect to said coolant inlet port, and said shell body is formed with another through hole positioned outside of said curved wall portion to be substantially symmetrical to said through hole in said cylindrical partition wall portion with respect to said coolant inlet port.

4. A coolant outlet element according to claim 1, wherein the outside configuration of said shell body is locally convex at portions where the temperature sensing elements are fitted and locally concave at portions between two adjacent portions where the temperature sensing elements are fitted so as to maintain a substantially constant cross sectional area of said coolant passage therealong.

* * * * *